US007828406B2

(12) United States Patent
Kim et al.

(10) Patent No.: US 7,828,406 B2
(45) Date of Patent: Nov. 9, 2010

(54) PRINT HEAD ERROR CHECKING APPARATUS AND METHOD

(75) Inventors: Sang-il Kim, Suwon-si (KR); Byeung-leul Lee, Yongin-si (KR); Seog-soon Baek, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 241 days.

(21) Appl. No.: 12/060,564

(22) Filed: Apr. 1, 2008

(65) Prior Publication Data

US 2009/0167807 A1 Jul. 2, 2009

(30) Foreign Application Priority Data

Dec. 27, 2007 (KR) ..... 10-2007-0138602

(51) Int. Cl.
*B41J 29/393* (2006.01)

(52) U.S. Cl. ..... 347/19

(58) Field of Classification Search ..... 347/19, 347/9–11; 358/504

See application file for complete search history.

(56) References Cited

U.S. PATENT DOCUMENTS 7,445,307 B2 * 11/2008 Sato ..... 347/19
7,448,717 B2 * 11/2008 Wanibe et al. ..... 347/19

* cited by examiner

*Primary Examiner*—Lamson D Nguyen
(74) *Attorney, Agent, or Firm*—Stanzione & Kim LLP

(57) ABSTRACT

Provided are a print head error checking apparatus and method in which the residual oscillation of a piezoelectric element corresponding to each nozzle of a print head is sensed, the sensed residual oscillation of each piezoelectric element and a predetermined residual oscillation of the piezoelectric element are compared to each other, and whether a print head normally operates is checked in consideration of the results of the comparisons.

17 Claims, 3 Drawing Sheets

PRINT HEAD ERROR CHECKING APPARATUS AND METHOD

CROSS-REFERENCE TO RELATED APPLICATIONS

This application claims the benefit of Korean Patent Application No. 10-2007-0138602, filed on Dec. 27, 2007, in the Korean Intellectual Property Office, the disclosure of which is incorporated herein in its entirety by reference.

BACKGROUND OF THE INVENTION

1. Field of the Invention

The present invention relates to an image forming apparatus such as a printer, and more particularly, to a print head of an inkjet printer.

2. Description of the Related Art

An inkjet printer comprises a plurality of nozzles in a print head and a plurality of piezoelectric elements which correspond to the nozzles one by one. Here, a piezoelectric element means a device that generates electricity when a pressure is applied to and changes in shape when a voltage is supplied generating a pressure. When print data to be printed are input to the inkjet printer, a voltage is supplied to each piezoelectric element in the printer head according to the print data. As a part of the piezoelectric element to which a voltage is supplied protrudes to eject droplets of ink contained in the print head through the corresponding nozzle.

A normal operation of the print head is obviously needed to print data to be distinct. For example, if ink is not normally ejected due to the clogging of nozzles, it is impossible to print data to be distinct. In order to check whether the print head normally operates, for example, when intending to eject ink through all nozzles, it is visually inspected whether ink is smoothly ejected from each of the nozzles with a lens or a monitor or by checking a printed sheet, which is printed for testing. However, both of these checking methods are considerably time consuming. For this reason, inkjet printers do not check during their printing operation whether the print head normally operates or not, for speedy printing. As a result, even when nozzle failure occurs during the printing operation, this failure is ignored and ink is wasted for the defective printed sheet.

SUMMARY OF THE INVENTION

The present invention provides a print head error checking apparatus that can rapidly check whether a print head normally operates.

The present invention provides a print head error checking method for rapidly checking whether a print head normally operates.

The present invention provides a computer readable recording medium storing a computer program for executing the method of rapidly checking whether a print head normally operates.

According to an aspect of the present invention, there is provided a print head error checking apparatus including a print head including a nozzle and a piezoelectric element corresponding to the nozzle; a sensing unit sensing the residual oscillation of the piezoelectric element caused due to the ejection of ink through the nozzle; and a checking unit checking whether the print head normally operates by comparing the sensed residual oscillation and a predetermined residual oscillation.

According to another aspect of the present invention, there is provided a print head error checking method including (a) ejecting ink through a nozzle in a print head; (b) sensing the residual oscillation of a piezoelectric element in the print head that corresponds to the nozzle; and (c) checking whether the print head normally operates by comparing the sensed residual oscillation and a predetermined residual oscillation.

According to another aspect of the present invention, there is provided a computer readable recording medium having embodied thereon a computer program for executing a print head error checking method including (a) ejecting ink through a nozzle in a print head; (b) sensing the residual oscillation of a piezoelectric element in the print head that corresponds to the nozzle; and (c) checking whether the print head normally operates by comparing the sensed residual oscillation and a predetermined residual oscillation.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Hereinafter, embodiments of a print head error checking apparatus and method will be described with reference to the appended drawings.

Figure 1:
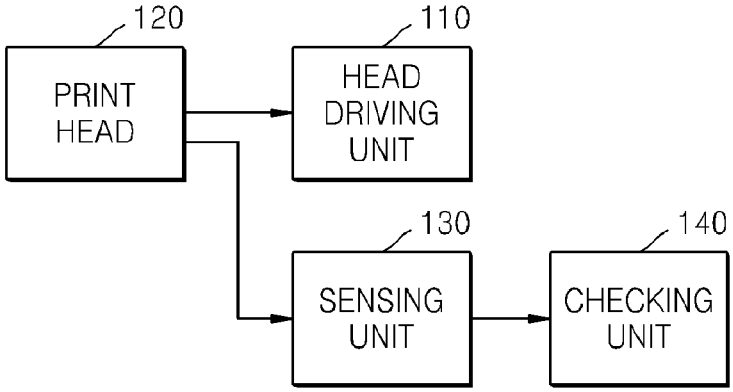
FIG. 1 is a block diagram of a print head error checking apparatus according to an embodiment of the present invention.

FIG. 1 is a block diagram of a print head error checking apparatus according to an embodiment of the present invention, which may include a print head 110, a head driving unit 120, a sensing unit 130, and a checking unit 140. For the convenience of explanation, it is assumed below that the print head 110, the head driving unit 120, the sensing unit 130, and the checking unit 140 are implemented in an inkjet printer.

The print head 110 includes a plurality of nozzles and a plurality of piezoelectric elements. Here, each nozzle corresponds to one piezoelectric element. As described above, when print data are input to the inkjet printer, a voltage is supplied to each piezoelectric element of the print head 110 according to the print data. A part of the piezoelectric element to which the voltage is supplied protrudes so that ink contained in the print head 110 is ejected out of the print head 110 through the nozzle corresponding to that piezoelectric element to which the voltage is supplied.

The head driving unit 120 and the sensing unit 130, which will be described later, perform an operation on each nozzle of the print head 110.

The head driving unit 120 drives the print head 110. In particular, when print data to be printed is input to the inkjet printer, the head driving unit 120 determines whether to eject ink through a nozzle in consideration of the print data, generates a print instruction signal for the nozzle that instructs the nozzle to eject ink if it is determined to eject ink through the nozzle, and supplies a voltage corresponding to the generated print instruction signal to the piezoelectric element corresponding to the nozzle, thereby driving the print head 110. Here, the print instruction signal may be a trigger signal.

The piezoelectric element whose shape has deformed to allow ink ejection through the nozzle still oscillates for a predetermined period of time after the ejection of ink through the nozzle. The sensing unit 130 senses the oscillation of the piezoelectric element corresponding to the nozzle through which ink has been ejected, after the ink ejection. The sensing unit 130 operates in response to a sensing instruction signal. To this end, the head driving unit 120 generates a sensing instruction signal for the nozzle from which ink has been ejected, the signal instructing the sensing unit 130 to operate, and outputs the sensing instruction signal to the sensing unit 130. Here, the sensing instruction signal may be a trigger signal. The head driving unit 120 may generate a sensing instruction signal simultaneously as whenever generating the print instruction signal. Alternatively, the head driving unit 120 may generate the sensing instruction signal once whenever a predetermined number of print instruction signals are generated.

The sensing unit 130 senses the residual oscillation of a piezoelectric element caused due to the ejection of ink from the nozzle, in response to the sensing instruction signal. Throughout the specification, the residual oscillation of the piezoelectric element means the oscillation of the piezoelectric element after a predetermined delay time from the ejection of ink through the nozzle. Here, the predetermined delay time may be arbitually varied. The sensing unit 130 may sense the residual oscillation of the piezoelectric element as a time domain signal. In particular, the sensing unit 130 may sense the residual oscillation of the piezoelectric element as a time domain signal with time on the horizontal axis and voltage on the vertical axis, the voltage being generated in the piezoelectric element due to the residual oscillation.

The checking unit 140 checks whether the print head 110 has an error by comparing the sensed residual oscillation and a predetermined residual oscillation. The checking unit 140 checks whether the print head 110 normally operates by checking whether the sensed residual oscillation has a predetermined similarity with respect to the predetermined residual oscillation. In particular, the sensing unit 130 performs an operation on each nozzle of the print head 110, and the checking unit 140 checks whether the print head 110 normally operates by comparing the residual oscillation of each piezoelectric element and the predetermined residual oscillation and considering the results of the comparisons. If a predetermined number of residual oscillations or more sensed by the sensing unit 130 is checked not to have a predetermined similarity with respect to the predetermined residual oscillation, the checking unit 140 recognizes the printer head 110 to have an error and not to normally operate. Meanwhile, if all the residual oscillations sensed by the sensing unit 130 have a predetermined similarity with respect to the predetermined residual oscillation, the checking unit 140 recognizes the printer head 110 not to have an error and to normally operate. If it is checked that the printer head 110 has an error, the inkjet printer performs maintenance and repair. Here, the maintenance and repair work is for allowing each nozzle in the print head 110 to smoothly eject ink.

Throughout the specification, the predetermined residual oscillation means 'a residual oscillation sensed by the sensing unit 130 when the print head 110 normally operates', which is previously set. The predetermined residual oscillation is set for each nozzle of the print head 110. In order for the sensing unit 130 to sense 'the predetermined residual oscillation, the print head 110 has to eject a predetermined amount of ink through each nozzle. It is determined by a user whether the print head 110 normally operates by visually checking the status of ink ejection from each nozzle with a lens or a monitor when the print head 110 ejects a predetermined amount of ink through each nozzle. Along with this, the sensing unit 130 senses the residual oscillation of the piezoelectric element corresponding to each nozzle of the print head 110 caused due to the ejection of ink through the nozzle. In the print head error checking apparatus according to the current embodiment of the present invention, if it is determined by the user that the printer head 110 normally operates, i.e., if it is determined by the user that all the nozzles normally eject ink, the residual oscillation of each piezoelectric element that is sensed by the sensing unit 130 during the normal operation of the print head 110 while the status of ink ejection from each nozzle is observed by the user, is set as "the predetermined residual oscillation" for the corresponding nozzle according to an instruction of the user. Meanwhile, if it is determined by the user that the printer head 110 does not normally operate, i.e., if it is determined by the user that there is a nozzle which do not normally eject ink, the inkjet printer performs maintenance and repair. As described above, the residual oscillation to be set as the predetermined residual oscillation for each nozzle should be the residual oscillation sensed by the sensing unit 130 during the normal operation of the print head 110, in which whether the print head 110 normally operates is determined by the user by visually checking the status of ink ejection from each nozzle with a lens or a monitor. However, the present invention is not limited to this, and thus it is satisfactory provided that the residual oscillation is determined by the sensing unit 130 during the normal operation of the print head 110 regardless of the method used to determine whether the print head 110 normally operates. However, for the convenience of explanation, it is assumed below that the residual oscillation to be set as the predetermined residual oscillation for each nozzle is the residual oscillation sensed by the sensing unit 130 during the normal operation of the print head 110 that is determined to be normal by the user by visually checking the status of ink ejection from each nozzle with a lens or a monitor.

The checking unit 140 checks whether the residual oscillation of each piezoelectric element that is currently sensed by the sensing unit 130 has a predetermined similarity with respect to the residual oscillation of each piezoelectric element that is previously sensed by the sensing unit 130 during the normal operation of the print head 110. As a result, if it is checked that the residual oscillations of more than a predetermined number of piezoelectric elements, which are currently sensed by the sensing unit 130, do not have a predetermined similarity with respect to the predetermined residual oscillations of the piezoelectric elements previously sensed by the sensing unit 130, the checking unit 140 recognizes the print head 110 to currently have an error.

Due to such operation of the checking unit 140, the print head error checking apparatus according to an embodiment of the present invention can rapidly and easily check whether the print head 110 normally operates. In other words, the print head error checking apparatus according to an embodiment of the present invention can check whether the print head 110 normally operates during the printing operation of an inkjet printer, without lowering the speed of printing print data. As a result, according to an embodiment of the present invention, even when the print head 110 malfunctions during the printing operation, the failure can be immediately detected to stop the ejection of ink, thereby preventing wasting of ink. In addition, the print head error checking apparatus according to an embodiment of the present invention can check whether the print head 110 normally operates during the maintenance and repair work of the inkjet printer. As a result, according to an embodiment of the present invention, if the print head 110 is restored to the normal condition before the inkjet printer completes the maintenance and repair work, it also can be immediately detected to prevent unnecessarily consumption of ink.

Figure 2:
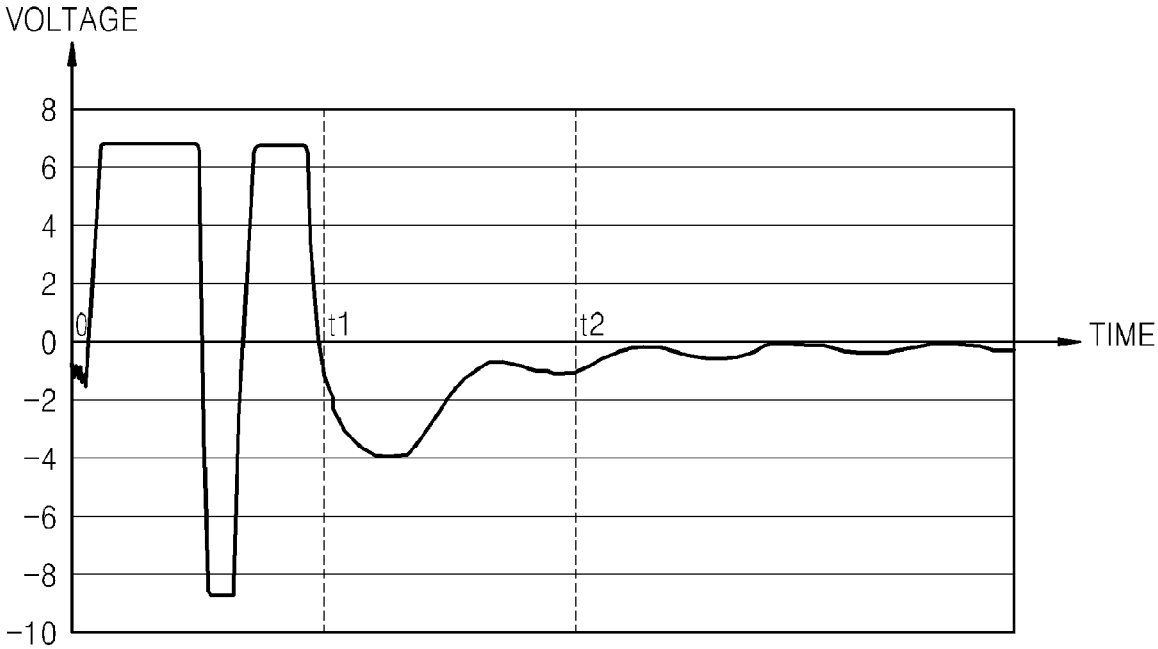
FIG. 2 is a waveform diagram for describing the operation of a sensing unit in FIG. 1.

FIG. 2 is a waveform of the residual oscillation of a piezoelectric element that is sensed by the sensing unit 130. The sensing unit 130 can sense a voltage generated in a piezoelectric element due to the residual oscillation of the piezoelectric element and output the sensed result as the 'currently sensed residual oscillation' of the piezoelectric element. However, the voltage generated in the piezoelectric element is a signal having a very small magnitude. For this reason, the sensing unit 130 may amplify a voltage by a predetermined multiple after sensing the voltage generated in the piezoelectric element and output the amplified result as 'the currently sensed residual oscillation' of the piezoelectric element. In particular, as shown in FIG. 2, the sensing unit 130 amplies a voltage generated in a piezoelectric element due to the residual oscillation of the piezoelectric element, which has occurred as a result of ink ejection through the corresponding nozzle, by a predetermined multiple, and outputs 'the result of the amplification by the predetermined multiple' as 'the currently sensed residual oscillation' of the piezoelectric element. FIG. 2 is a waveform of this sensed residual oscillation of the piezoelectric element.

Referring to FIG. 2, when t=0, where t denotes time, the head driving unit 120 generates a print instruction signal and a sensing instruction signal for a nozzle. The print head 110 ejects ink through the nozzle at t=0. The sensing unit 130 senses the residual oscillation of the piezoelectric element corresponding to the nozzle at t≧t1, where t1 is a real number greater than 0. In other words, the terms 'a predetermined delay time' throughout the specification means 't1 (∵t1−0)', which is shown in FIG. 2.

In addition, due to other devices implemented on a circuit together with the sensing unit 130, an offset is reflected in the voltage sensed by the sensing unit 130. For this reason, when the checking unit 140 checks whether the printer head 110 currently has an error by comparing 'the currently sensed residual oscillation' and 'the predetermined residual oscillation', the checking unit 140 may check whether the print head 110 currently has an error by removing an offset from each of 'the currently sensed residual oscillation' and 'the predetermined residual oscillation' and comparing 'the currently sensed residual oscillation' from which the offset has been removed and 'the predetermined residual oscillation' from which the offset has been removed. Alternatively, the checking unit 140 may check whether the print head 110 currently has an error by comparing 'the currently sensed residual oscillation' in which an offset is reflected and 'the predetermined residual oscillation' in which an offset is reflected. When the checking unit 140 checks whether the printer head 110 currently has an error by comparing 'the currently sensed residual oscillation' from which an offset has been removed and 'the predetermined residual oscillation' from which an offset has been removed, the checking unit 140 may recognize in advance 'the predetermined residual oscillation' from which the offset has been removed. The checking unit 140 may measure an offset in the 'currently sensed residual oscillation' and subtract the measured offset from 'the currently sensed residual oscillation', and then compare the result of the subtraction and 'the predetermined residual oscillation' from which the offset has been removed. Here, the checking unit 140 may measure an offset after a predetermined offset sensing time passes upon the generation of the sensing instruction signal. The predetermined offset sensing time may be longer than a predetermined delay time. Referring to FIG. 2, the sensing unit 130 senses the residual oscillation at t≧t2, where t2 is a real number greater than t1, and the checking unit 140 measures an offset using the residual oscillation sensed at t≧t2.

Figure 3:
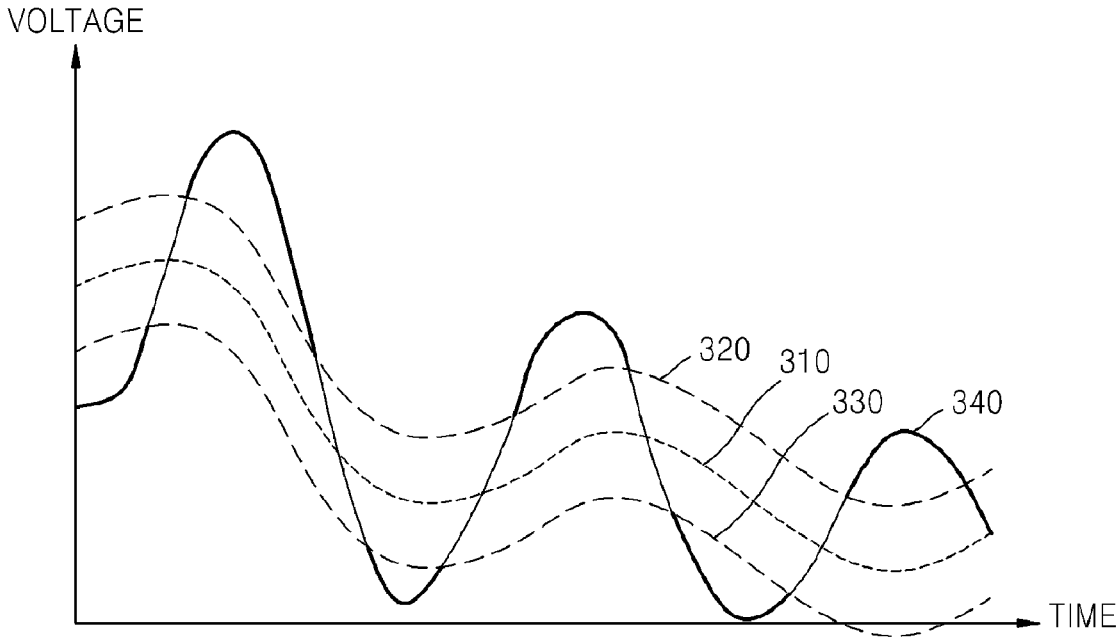
FIG. 3 is a waveform diagram for describing the operation of a checking unit in FIG. 1.

FIG. 3 is a waveform diagram for describing the operation of the checking unit 140 in FIG. 1.

The checking unit 140 checks whether the print head 110 currently has an error by checking whether 'the currently sensed residual oscillation' for a nozzle has a predetermined similarity with respect to a predetermined residual oscillation 310 for the nozzle. In particular, the checking unit 140 checks whether 'the currently sensed residual oscillation 340' for a nozzle fully belongs in the region defined by waveforms 320 and 330 enveloping the predetermined residual oscillation 310 for the nozzle. If it is checked that part of 'the currently sensed residual oscillation 340' for the nozzle does not belong in that region, the checking unit 140 recognizes the print head 110 currently to have an error. The shape of these waveforms 320 and 330 are previously set.

In FIG. 3, part of 'the currently sensed residual oscillation 340' for the nozzle does not belong in the region defined by the waveforms 320 and 330 enveloping the predetermined residual oscillation 310 for the nozzle, the checking unit 140 recognizes the print head 110 to currently have an error.

Figure 4:
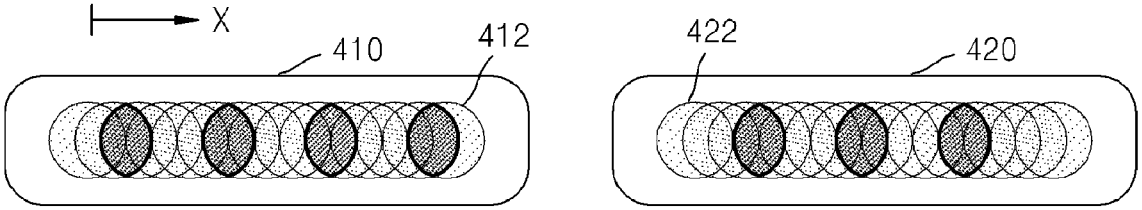
FIGS. 4 and 5 are diagrams for describing the operation of a print head, the sensing unit, and the checking unit in FIG. 1 for high-frequency printing.
Figure 5:
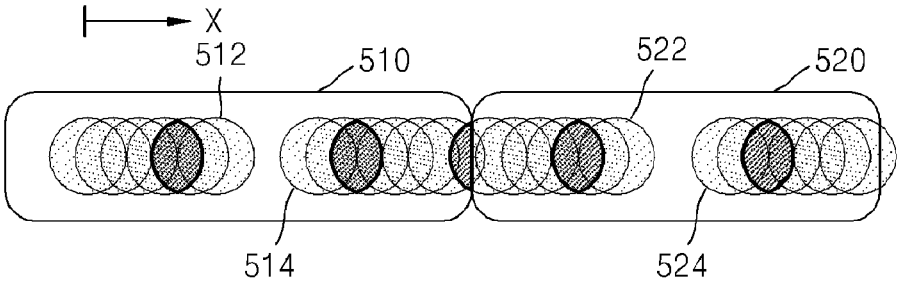

FIGS. 4 and 5 are diagrams for describing the operation of the print head 110, the sensing unit 130, and the checking unit 140 in FIG. 1 for high-frequency printing. In FIGS. 4 and 5, circles represent circular images formed on a printing medium as the print head 110 moves in the X-axial direction and ejects ink through a nozzle. In FIG. 4, pixels 410 and 420 on the printing medium have a gap between them. However, in FIG. 5, pixels 510 and 520 on the printing medium contact each other.

If the interval between a point of time of the $n^{th}$ ink ejection and a point of time of the $(n+1)^{th}$ ink ejection, where n is a natural number, is too small, a $n^{th}$ time domain in which the residual oscillation of the piezoelectric element caused due to the $n^{th}$ ink ejection through the nozzle remains may overlap with a $(n+1)^{th}$ time domain in which the residual oscillation of the piezoelectric element caused due to the $(n+1)^{th}$ ink ejection through the nozzle remains. However, in this case, it is difficult to accurately check whether the $n^{th}$ ink ejection through the nozzle has normally been performed based on the residual oscillation of the piezoelectric element sensed in the $n^{th}$ time domain. This is because the residual oscillation of the piezoelectric element sensed in the $n^{th}$ time domain is attributed to the $n^{th}$ ink ejection and the $(n+1)^{th}$ ink ejection through the nozzle.

Thus, if the ink ejection frequency of a nozzle is so low that the $n^{th}$ time domain and the $(n+1)^{th}$ time domain do not overlap, the print head error checking apparatus according to an embodiment of the present invention can check whether the print head 110 normally operates by sensing the residual oscillation of the piezoelectric element corresponding to the nozzle whenever ink is ejected through the nozzle and comparing the sensed residual oscillation and a predetermined residual oscillation for the nozzle. Throughout the specification, the ink ejection frequency of a nozzle means the number of ink ejections through the nozzle.

However, if the ink ejection frequency of a nozzle is so high that the $n^{th}$ time domain and the $(n+1)^{th}$ time domain overlap, the print head error checking apparatus according to an embodiment of the present invention cannot accurately check whether the print head 110 normally operates by sensing the residual oscillation of the piezoelectric element corresponding to the nozzle whenever ink is ejected through the nozzle and comparing the sensed residual oscillation and a predetermined residual oscillation for the nozzle. Like this, if the ink ejection frequency of a nozzle is high, the operation frequency of the sensing unit 130 may be equal to or smaller than the ink ejection frequency of the nozzle. In other words, if the ink ejection frequency of a nozzle is high, the head driving unit 120 may generate a sensing instruction signal once whenever a predetermined number of print instruction signals is generated. In particular, if the ink ejection frequency of each nozzle in the print head 110 is high, the sensing unit 130 may operate during a predetermined waiting time following the ink ejection of a nozzle and for which no ink ejection of the nozzle occurs. Here, the predetermined waiting time may be arbitrarily varied.

Referring to FIG. 4, the interval between the point of time of the last ink ejection onto the pixel 410 at which a circular image indicated by reference numeral 412 is formed on the printing medium and the point of time of the first ink ejection onto the next pixel 420 at which a circular image indicated by reference numeral 422 is formed on the printing medium, is equal to or longer than the predetermined waiting time. Thus, in this case, the sensing unit 130 senses the residual oscillation of the piezoelectric element cased due to the last ink ejection onto the pixel 410, and the checking unit 140 can accurately check whether the print head 110 normally operates by comparing the sensed residual oscillation and a predetermined residual oscillation.

Referring to FIG. 5, the interval between the point of time of the sixth ink ejection onto the pixel 510 at which a circular image indicated by reference numeral 512 is formed on the printing medium and the point of time of the seventh ink ejection onto the same pixel 510 at which a circular image indicated by reference numeral 514 is formed on the printing medium, is equal to or longer than the predetermined waiting time. In addition, the interval between the point of time of the sixth ink ejection onto another pixel 520 at which a circular image indicated by reference numeral 522 is formed on the printing medium and the point of time of the seventh ink ejection onto the same pixel 520 at which a circular image indicated by reference numeral 524 is formed on the printing medium, is equal to or longer than the predetermined waiting time. Thus, in this case, the sensing unit 130 senses the residual oscillation of the piezoelectric element cased due to the sixth ink ejection onto the pixel 510, and the checking unit 140 can accurately check whether the print head 110 normally operates by comparing the sensed residual oscillation and a predetermined residual oscillation. Similarly, the sensing unit 130 senses the residual oscillation of the piezoelectric element cased due to the sixth ink ejection onto the pixel 520, and the checking unit 140 can accurately check whether the print head 110 normally operates by comparing the sensed residual oscillation and a predetermined residual oscillation.

Figure 6:
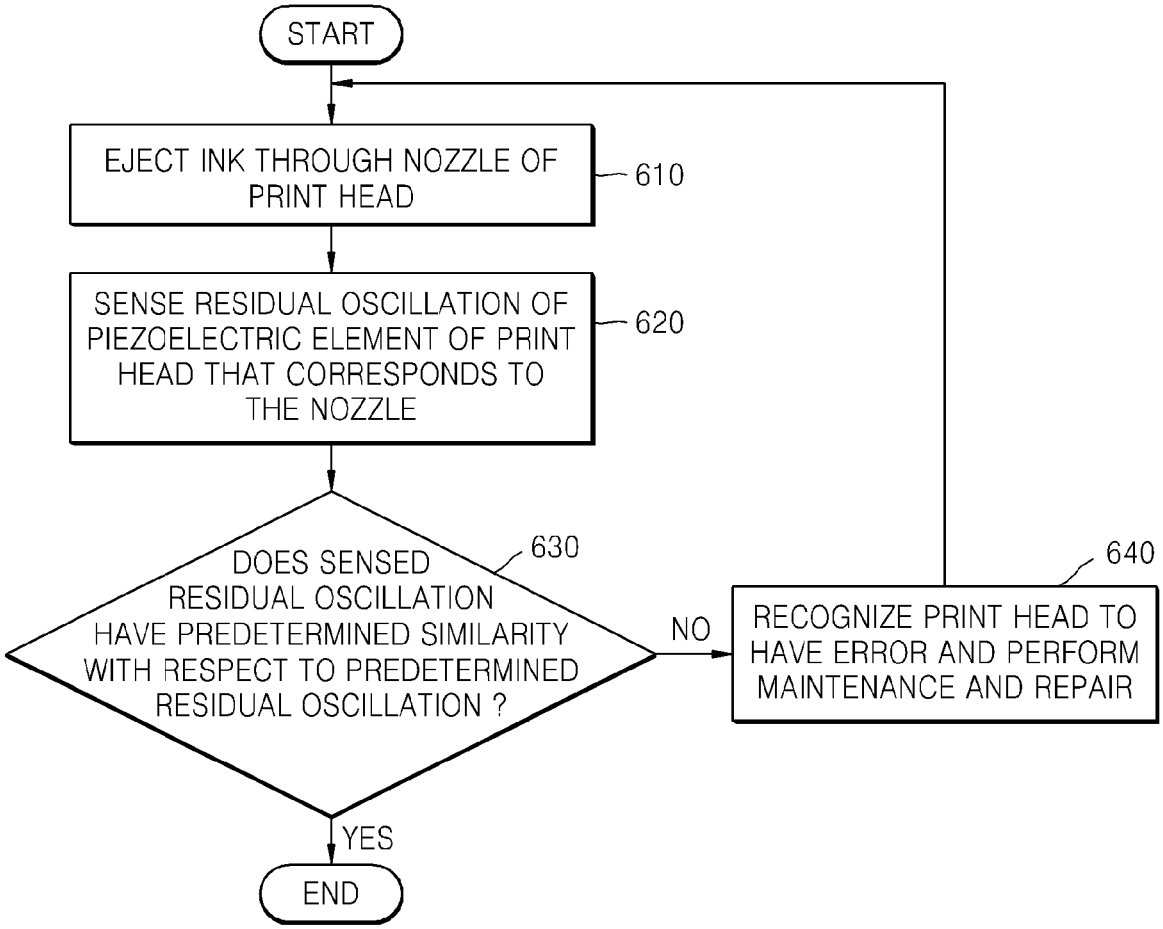
FIG. 6 is a flowchart of a print head error checking method according to an embodiment of the present invention.

FIG. 6 is a flowchart of a print head error checking method according to an embodiment of the present invention, which includes operations 610 through 640 for rapidly checking whether the print head 110 normally operates.

The print head 110 ejects ink through a nozzle in the print head 110 (operation 610). The sensing unit 130 senses the residual oscillation of a piezoelectric element in the print head 110 that corresponds to the nozzle (operation 620).

After operation 620, the checking unit 140 checks whether the residual oscillation sensed in operation 620 has a predetermined similarity with respect to a predetermined residual oscillation (operation 630).

Operations 610 through 630 may be performed on each nozzle of the print head 110. In this case, if it is checked that the residual oscillations of the piezoelectric elements corresponding to a predetermined number of nozzles or more do not have a predetermined similarity with respect to a predetermined residual oscillation for each of the predetermined number of nozzles or more, the checking unit 140 recognizes the print head 110 to have an error, and the inkjet printer performs maintenance and repair (operation 640). Next, the process moves onto operation 610. Meanwhile, after operations 610 through 630 have been performed on each of the nozzles of the print head 110, if it is checked that the residual oscillations of the piezoelectric elements corresponding to all the nozzles of the print head 110 have a predetermined similarity with respect to a predetermined residual oscillation for each of the nozzles, the checking unit 140 recognizes the print head 110 not to have an error.

The print head error checking method according to an embodiment of the present invention can be written as a computer program and can be implemented in general use digital computers that execute the program using a computer readable recording medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet).

While this invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A print head error checking apparatus comprising:

a print head including a nozzle and a piezoelectric element corresponding to the nozzle;

a sensing unit sensing the residual oscillation of the piezoelectric element caused due to the ejection of ink through the nozzle; and a checking unit checking whether the print head normally operates by comparing the sensed residual oscillation and a predetermined residual oscillation, wherein the operation frequency of the sensing unit is equal to or smaller than the ink ejection frequency of the nozzle.

2. The print head error checking apparatus of claim 1, wherein the checking unit checks whether the print head normally operates by checking whether the sensed residual oscillation has a predetermined similarity with respect to the predetermined residual oscillation.

3. The print head error checking apparatus of claim 1, wherein the predetermined residual oscillation is a residual oscillation previously sensed when the print head normally operates, and the checking unit compares the sensed residual oscillation, which is currently sensed by the sensing unit, and the predetermined residual oscillation.

4. The print head error checking apparatus of claim 1, wherein the print head includes a plurality of nozzles, the sensing unit performs an operation on each nozzle, and the checking unit checks whether the print head normally operates in consideration of the results of comparing the residual oscillation of each piezoelectric element corresponding to one of the nozzles and the predetermined residual oscillation for each nozzle.

5. The print head error checking apparatus of claim 1, wherein the checking unit operates during a predetermined waiting time following the ink ejection of the nozzle and for which no ink ejection of the nozzle occurs.

6. The print head error checking apparatus of claim 1, wherein the sensed residual oscillation and the predetermined residual oscillation are time domain signals.

7. The print head error checking apparatus of claim 1, wherein the residual oscillation of the piezoelectric element is the oscillation of the piezoelectric element after a predetermined delay time from the ink ejection of the nozzle.

8. A print head error checking apparatus comprising:

a print head including a nozzle and a piezoelectric element to correspond to the nozzle;

a sensing unit to sense a residual oscillation of the piezoelectric element caused by ejection of ink through the nozzle; and a checking unit checking whether the print head normally operates by comparing the sensed residual oscillation and a predetermined residual oscillation;

wherein the checking unit checks whether the print head normally operates by comparing the sensed residual oscillation and the predetermined residual oscillation after an offset has been removed from each of the sensed residual oscillation and the predetermined residual oscillation.

9. A print head error checking method comprising:

(a) ejecting ink through a nozzle in a print head;

(b) sensing the residual oscillation of a piezoelectric element in the print head that corresponds to the nozzle; and (c) checking whether the print head normally operates by comparing the sensed residual oscillation and a predetermined residual oscillation, wherein the frequency of performing the sensing in (b) is equal to or smaller than the frequency of performing the ejecting in (a).

10. The print head error checking method of claim 9, wherein, in (c), it is checked whether the print head normally operates by checking whether the sensed residual oscillation has a predetermined similarity with respect to the predetermined residual oscillation.

11. The print head error checking method of claim 9, wherein the predetermined residual oscillation is a residual oscillation previously sensed when the print head normally operates, and, in (c), the sensed residual oscillation, which is currently sensed in (b), and the predetermined residual oscillation are compared to each other.

12. The print head error checking method of claim 9, wherein the print head includes a plurality of nozzles, the sensing in (b) is performed on each nozzle, and the checking of (c) whether the print head normally operates in (c) is performed in consideration of the results of comparing the residual oscillation of each piezoelectric element corresponding to one of the nozzles and the predetermined residual oscillation for each nozzle.

13. The print head error checking method of claim 9, wherein the sensing in (b) is performed during a predetermined waiting time following the ejecting in (a) and for which no ink ejection of (a) occurs.

14. The print head error checking method of claim 9, wherein the sensed residual oscillation and the predetermined residual oscillation are time domain signals.

15. The print head error checking method of claim 9, wherein, in (c), it is checked whether the print head normally operates by comparing the sensed residual oscillation and the predetermined residual oscillation after an offset has been removed from each of the sensed residual oscillation and the predetermined residual oscillation.

16. The print head error checking method of claim 9, wherein the residual oscillation of the piezoelectric element is the oscillation of the piezoelectric element after a predetermined delay time from the ink ejection of the nozzle.

17. A computer readable recording medium having embodied thereon a computer program for executing the print head error checking method of any one of claims 9 through 12 and 13 through 16.

* * * * *